United States Patent [19]

Arter et al.

[11] Patent Number: 4,590,151

[45] Date of Patent: May 20, 1986

[54] REDUCTION OF RETICULATION IN GELATIN-CONTAINING ELEMENTS

[75] Inventors: Thomas C. Arter, Rochester; Ignazio S. Ponticello, Pittsford, both of N.Y.

[73] Assignee: Eastman Kodak Company, Rochester, N.Y.

[21] Appl. No.: 444,944

[22] Filed: Nov. 29, 1982

[51] Int. Cl.[4] ..... G03C 1/76; G03C 1/30; G03C 1/02; B41L 27/26

[52] U.S. Cl. ..... 430/537; 430/539; 430/621; 430/622; 430/629; 430/627; 101/125; 428/478.2

[58] Field of Search ..... 430/537, 539, 621, 622, 430/629, 627; 428/478.2; 106/125

[56] References Cited

U.S. PATENT DOCUMENTS

| | | | |
|---|---|---|---|
| 3,057,723 | 10/1962 | Jeffreys | 430/449 |
| 3,330,664 | 7/1967 | Minsk et al. | 430/621 |
| 3,839,042 | 10/1974 | Silverman et al. | 96/50 R |
| 3,926,869 | 12/1975 | Horie et al. . | |
| 4,021,245 | 5/1977 | Nagatomo et al. | 430/539 X |
| 4,161,407 | 7/1979 | Campbell | 430/622 X |
| 4,172,732 | 10/1979 | Miyazako et al. . | |
| 4,460,680 | 7/1984 | Ogawa et al. | 430/539 |
| 4,476,218 | 10/1984 | Ogawa et al. | 430/539 X |
| 4,481,284 | 11/1984 | Ogawa et al. | 430/355 |
| 4,508,818 | 4/1985 | Ogawa et al. | 430/539 X |

FOREIGN PATENT DOCUMENTS

| | | | |
|---|---|---|---|
| 56-142524 | 11/1981 | Japan . | |
| 2037738 | 7/1980 | United Kingdom . | |
| 2103817 | 2/1983 | United Kingdom | 430/434 |

OTHER PUBLICATIONS

"Reticulation in Gelatin Layers", by E. Tojo et al in *Photographic Gelatin,* R. J. Cox, Editor, Academic Press, 1972.

D. M. Burness and J. Pouradier, "III, The Hardening of Gelatin and Emulsions", pp. 577–587 in *The Theory of the Photographic Process,* Fourth ed., edited by T. H. James (MacMillan Publishing Co., Inc., New York, N.Y. 1977).

*Primary Examiner*—John E. Kittle
*Assistant Examiner*—Cynthia Hamilton
*Attorney, Agent, or Firm*—Arthur H. Rosenstein

[57] ABSTRACT

Reticulation caused by swelling with processing solutions in photographic elements is reduced for elements containing at least two contiguous gelatin-containing layers wherein the uppermost layer has a lateral swell coefficient at least 10% greater than the lower gelatin-containing layer before polymer addition and wherein said uppermost layer comprises an essentially non-diffusible vinyl polymer having reactive groups which crosslink by reaction with primary amine or secondary amine groups on gelatin or a water-soluble, non-diffusible amine containing vinyl polymer and a hardener for gelatin. These elements are particularly useful in photographic products.

22 Claims, No Drawings

REDUCTION OF RETICULATION IN GELATIN-CONTAINING ELEMENTS

BACKGROUND OF THE INVENTION

1. Field of the Invention

This invention relates to an element, preferably photographic element, containing at least two contiguous gelatin-containing layers wherein reticulation is reduced.

2. State of the Art

The use of gelatin, a hydrophilic colloid, as the binding agent or vehicle in photographic silver halide emulsions and elements is well known. Attempts have been made to substitute various synthetic and natural materials for all or a part of the gelatin to improve certain photographic and physical properties.

However, improvement in one property is generally achieved at the expense of another and often more important property. For example, substitution of part of the gelatin with at least one other hydrophilic colloid as the vehicle or binding agent in a silver halide emulsion layer increases the covering power, thus yielding a higher density upon development for the same amount of silver per unit area. This often reduces layer mechanical strength.

Such layers do not have good abrasion resistance and must therefore usually be coated with an overcoat layer. It has been found that overcoat layers, containing gelatin and mixtures of gelatin and other hydrophilic colloids are suitable for this purpose. The addition of certain materials to both the silver halide layer and the overcoat layer improves resistance to abrasion, particularly when processed in high speed automatic processing equipment such as described in U.S. Pat. No. 3,147,090 and 3,025,779. This equipment is particularly important, for example, in hospitals where rapid access to emergency x-ray photographs are desired in emergency situations and in high volume. The use of high-speed, high-temperature processing operations, however, results in a reticulation problem in the photographic element. The gelatin-containing overcoat layer swells at a different rate than the gelatin-containing silver halide layer which results in layer buckling.

The use of fillers containing gelatin hardeners to reduce overcoat layer lateral swell, does reduce the tendency of the element to reticulate. The addition of diffusible hardeners in the overcoat layer which migrate to the silver halide layer aids in reducing reticulation but also reduces sensitivity of the element. Examples of the use of these gelatin hardeners are found in U.S. Pat. Nos. 3,926,869 and 4,172,732.

Non-diffusible hardeners have not been used in the overcoat layer, as these hardeners are known to increase reticulation as described in "Reticulation in Gelatin Layers" by E. Tojo et al in *Photographic Gelatin,* R. J. Cox, Editor, Academic Press, 1972.

It is highly desirable to provide an element comprising two contiguous gelatin-containing layers containing an additive which reduces reticulation without adversely affecting other properties of the element to allow the use of high-speed coating operations.

SUMMARY OF THE INVENTION

These problems can be solved with an element containing two contiguous gelatin-containing layers, the first uppermost layer containing an essentially water-soluble, non-diffusible vinyl polymer having one or more groups selected from the group consisting of (1) groups which react with gelatin to crosslink the polymer and gelatin and (2) amine groups, said uppermost layer containing from about 1 to about 90% by weight of said polymer and having a lateral swell coefficient in the absence of said polymer at least 10% greater than the second lower gelatin-containing layer, said first uppermost layer containing the polymer having amine groups also containing a hardener for gelatin.

In one embodiment of the present invention, an element comprises a support having thereon at least two contiguous gelatin-containing layers, the uppermost layer containing an essentially water-soluble, non-diffusible polymer having one or more groups which react with the primary or secondary amine groups on gelatin such as chloroethylsulfonyl groups or an essentially water-soluble, non-diffusible amine containing vinyl polymer wherein the uppermost layer also comprises a hardener for gelatin, said uppermost layer containing from about 1 to about 90% by weight of said polymer.

A preferred embodiment of the present invention comprises a photographic element comprising a support having thereon a gelatin-containing radiation-sensitive layer and an overcoat layer containing gelatin and the above-described polymer.

A further embodiment of the present invention comprises a method of reducing reticulation, after processing and drying, of an element comprising a support having thereon at least two contiguous gelatin-containing layers, the uppermost layer having a lateral swell coefficient at least 10% greater than the lower gelatin-containing layer comprising incorporating a polymer as described above in the uppermost gelatin-containing layer.

DESCRIPTION OF THE PREFERRED EMBODIMENTS

The element in which the essentially watersoluble, non-diffusible polymer is useful comprises a support and at least two contiguous gelatin-containing layers, the uppermost layer having a lateral swell coefficient at least 10% greater than that of the lower gelatin-containing layer.

The support is any material capable of having the gelatin-containing layers coated thereon. Preferred support materials are those which have been found to be useful as supports in photographic elements such as cellulose nitrate film, cellulose ester film, poly(vinyl acetal), poly(ethylene terephthalate) and other polyesters, glass, paper, metals and wood. The support has at least two layers on one side but may be coated with various layers on both sides.

The lower gelatin-containing layer is any layer containing gelatin. In preferred embodiments, the lower layer contains non-swelling materials such as silver halide, salts, sensitizers, coupler dispersions, polymeric latexes, antifoggants and stabilizers. The weight ratio of gelatin to non-swellable material is preferably from about 0.1:1 to 10:1 and more preferably about 1.3 to 1.

The lower layer is either directly coated on the support or coated over another layer, such as a subbing layer. The lower layer optionally contains other addenda such as diffusible hardeners such as succinaldehyde, glutaraldehyde, formaldehyde, bis(vinylsulfonylmethyl) ether, bis(vinylsulfonyl)methane and N,N'-diacryloylurea to reduce reticulation. Examples of these hardeners are found in U.S. Pat. Nos. 3,839,042, 3,926,869 and 4,172,732.

The uppermost gelatin-containing layer is contiguous to the lower gelatin-containing layer and, in one embodiment, contains gelatin and an essentially water-soluble, non-diffusible polymer hardener. The uppermost gelatin-containing layer optionally contains a small amount of non-swelling materials. Preferably, the ratio of gelatin to non-swelling materials in the uppermost layer (prior to the incorporation of the non-diffusible polymer) is no less than 5:1 and preferably 10:1 to 20:1.

When a gelatin-containing layer is rewet, as in a photographic developing process, it tends to swell as it absorbs water. Most of this swell is in the vertical direction if the proper structure has been developed during the coating and drying operation. However, there is a horizontal or lateral swell component which often causes the gelatin surface to reticulate or buckle.

When rewet, such as during processing, the gelatin structure in each of the layers swells as it absorbs aqueous processing solutions. As the uppermost layer has less non-swelling material per volume of coating than does the lower layer, it can absorb more water and swell more. As the uppermost layer is contiguous to the lower layer, the tendency for each of the layers to swell to different lengths causes stress between the two layers and a buckling of the surface of the uppermost layer when these stresses are relieved during rewetting.

Reticulation is a serious problem when the uppermost gelatin-containing layer has a lateral swell coefficient in the absence of the non-diffusible polymer at least 10% greater than the lower gelatin-containing layer. Therefore, the present invention is drawn to the use of a reticulation reducing material in the uppermost layer of an element containing two gelatin layers wherein the uppermost gelatin-containing layer has a lateral swell coefficient at least 10% greater than that of the lower gelatin-containing layer before addition of the polymer hardener.

Lateral swell coefficient of the gelatin-containing layers is determined by lateral swell measurements of stripped layers placed in processing solutions. The amount of lateral swell in the horizontal direction is measured by dimensional change between the dry and rewet gelatin layers. The lateral swell coefficient is the percentage changed in lateral dimensional size which has occurred. Thus, if the lower gelatin-containing layer has a lateral swell coefficient of 200%, then the uppermost gelatincontaining layer of the invention has a lateral swell coefficient of 220% or greater.

By "essentially water-soluble" is meant that the polymer is soluble in water, but resulting solutions may contain small amounts of particles so that the solution is clear or only slightly hazy.

The non-diffusible polymer hardener useful in one embodiment of this invention comprises one or more groups, which react with the primary amine or secondary amine groups on gelatin to crosslink the polymer with the gelatin. The reticulation reducing property of the polymer is a result of the ability of the polymer to crosslink with gelatin.

Representative reactive groups which react with and thus crosslink gelatin are aldehydes, active esters such as described in U.S. Pat. No. 3,542,558, sulfonate esters active halogens such as described in U.S. Pat. No. 3,106,468, epoxides such as described in U.S. Pat. No. 3,047,394, aziridines such as described in U.S. Pat. No. 2,950,197, active olefins such as described in U.S. Pat. Nos. 3,490,911, 3,539,644, 3,841,872 and 3,640,720, chloro-s-triazine as shown in U.S. Pat. No. 4,168,976, vinylsulfonyl groups and carbodimides such as described in U.S. Pat. No. 1,148,446. Particularly preferred groups are those containing haloethylsulfone groups or derivatives thereof such as described in U.S. Pat. No. 4,161,407.

In addition to recurring units comprising the reactive groups defined above, the polymer hardeners of this invention can comprise recurring units derived from other inert monomers which provide the hydrophobic-hydrophilic balance necessary for compatibility of the polymer with gelatin. Acrylamide is such a preferred comonomer, however, other monomers such as alkyl acrylates, styrene, vinyl esters, vinyl ethers, and the like can be employed. Hydrophobic monomers function as fillers and further reduce the swell ratio thus reducing reticulation after processing. Hydrophilic monomers improve compatibility with gelatin.

By "inert", is meant groups which will not react with the active crosslinking groups on the polymer. Groups such as primary and secondary amine, active methylene, and in the case of some hardeners, carboxy and hydroxy groups, are not considered inert.

Non-diffusible polymeric hardeners useful herein are disclosed in the following U.S. Pat. Nos. 3,330,664, 3,306,750, 3,296,155, 3,277,030, 3,308,075, 3,671,256, 3,533,800 and 4,161,407.

The preferred polymers for purposes of reticulation reduction have the formula:

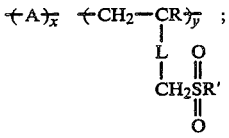

where

A is a polymerized $\alpha,\beta$-ethylenically unsaturated addition polymerizable monomer or a mixture of such polymerized monomers;

x is a positive number such that (A) comprises 10 to 99% by weight of said polymer;

y is a positive number such that

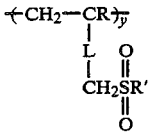

comprises 1 to 90% by weight of said polymer;

L is a linking group selected from the group consisting of alkylene preferably containing 1 to 6 carbon atoms such as methylene, ethylene and propylene; arylene such as phenylene; COZ and $COZR^3$;

$R^3$ is selected from the group consisting of alkylene preferably containing from 1 to 6 carbon atoms and arylene;

Z is O or NH;

R is hydrogen or alkyl having 1 to 6 carbon atoms;

R' is $-CH{=}CHR^2$ or $-CH_2CH_2X$ where X is a leaving group which can be displaced by a nucleophile such as chloro, bromo, iodo, acetoxy, methylsulfonyloxy, trimethylammonio salt or pyridinio salt or can be eliminated in the form of HX upon treatment with base; and $R^2$ is hydrogen, alkyl or aryl.

In the preferred polymer, X is selected from the group consisting of chloro, bromo, iodo, acetoxy, methylsulfonyloxy, trimethylammonio salt, and pyridinio salt; A is derived from 2-acrylamido-2-methylpropanesulfonic acid or salts thereof, acrylamide, vinylbenzyl chloride, styrene or maleic anhydride; and L is phenylene. Examples of these polymers and gelatin-containing layers containing same are described in U.S. Pat. No. 4,161,407.

A preferred polymer is poly(acrylamide-co-2-chloroethylsulfonyl methylstyrene) (weight ratio 90 to 10).

In the preferred embodiment, the uppermost gelatin-containing layer comprises from about 2 to about 90% by weight of the polymer. Most preferably, the layer comprises 10 to 20% by weight of the polymer. The polymer is generally incorporated in the uppermost layer by adding the polymer to the gelatin coating composition prior to depositing the coating.

The uppermost gelatin-containing layer also optionally contains an additional filler such as colloidal silica in addition to the above-described polymer.

In another embodiment, the uppermost gelatin-containing layer comprises an essentially water-soluble, non-diffusible amine-containing polymer and a hardener for gelatin.

Examples of amine-containing vinyl polymers useful herein include primary and secondary aminecontaining polymers such as polymers and copolymers of N-(3-aminopropyl) methacrylamide hydrochloride, N-methyl-2-aminoethyl methacrylate hydrochloride, N-(2-aminoethyl) methacrylamide hydrochloride, 2-aminoethyl methacrylate hydrochloride, and N-(2-amino-2-methylpropyl) methacrylamide hydrochloride. A preferred copolymer is

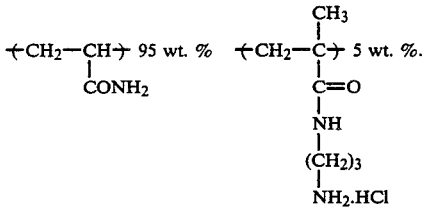

The concentration range of amine-containing vinyl polymer is essentially the same as that for polymers containing groups which react with gelatin to crosslink the polymer in gelatin.

The hardener in the uppermost layer with the vinyl polymer containing amine groups is any conventional hardener such as diffusible hardeners such as bis(vinylsulfonyl)methane, formaldehyde, succinaldehyde, glutaraldehyde, bis(vinylsulfonylmethyl) ether, and N,N'-diacryloylurea such as those found in U.S. Pat. No. 3,926,869 and 4,172,732. The hardener is generally present in this embodiment in a concentration of 0.25 to 5 and preferably from 1 to 3% of the weight of gelatin.

The preferred use of the elements of this invention is in photographic elements. In photographic elements, the support is coated with a radiation-sensitive layer such as a silver halide emulsion layer containing gelatin, dried, exposed and developed in a liquid developer. As the drying time is extended, the risk of reticulation is lessened, but the process is more expensive and the coating speed is necessarily slowed down. This reduces the production capacity of the photographic element.

In order to protect the silver halide layer from physical degradation such as abrasion, an overcoat containing gelatin is placed contiguous to the silver halide layer. The silver halide layer, however, has a much lower lateral swell coefficient than that of the top coat and a reticulation problem exists under most coating conditions. The incorporation of the polymer described hereinabove in the overcoat layer significantly reduces reticulation while retaining the abrasion resistance of the element and does not adversely affect sensitometry of the photographic element.

Using the photographic element described above, a shorter drying time is possible, thus greatly extending the amount of photographic element which can be produced. Photographic elements containing overcoats without the polymer described above are generally described in U.S. Pat. No. 3,591,379.

The following examples illustrate the invention.

EXAMPLES 1-2

A control element and two elements of the present invention were prepared. All of the elements contained the same first coating structure of four layers, consisting of two emulsion layers and two gelatin layers, simultaneously coated on a poly(ethylene terephthalate) film support, as described in Table I. Drying of the first coating structure was accomplished in two stages, the first for 0.17 minutes at 16° C. Dry Bulb and 7° C. Wet Bulb, the final stage for 2.63 minutes at 29° C. Dry Bulb and 16° C. Wet Bulb.

In a second coating application, an emulsion layer and the control gelatin overcoat layer were simultaneously coated over the first coating structure with the composition described in Table I. Each of the emulsion layers contained a color-forming coupler in addition to gelatin and silver halide. Drying of the second coating application was also accomplished in two stages, Stage 1 for 0.17 minutes at 16° C. Dry Bulb and 7° C. Wet Bulb, and Stage 2 at three different drying rates to provide drying times of 1.20 minutes, 1.33 minutes and 1.60 minutes, and Wet Bulb temperatures of 12°, 13°, 14°, 16° and 17° C. The diffusible hardener bis(vinylsulfonyl)methane was added to the emulsion layer of the second coating application in an amount providing 1.75 percent of the gelatin weight of the total coated structure.

In Example 1 of the present invention, 14 percent of the gelatin of the control overcoat layer was replaced by Polymer 1, a copolymer of acrylamide (90 weight percent) and (2-chloroethylsulfonylmethyl)styrene (10 weight percent), prepared as described in Example 5 of U.S. Pat. No. 4,161,407. In Example 2 of the present invention, 14 percent of the gelatin of the control overcoat was replaced by Polymer 1, and an additional 26 percent of the gelatin of the overcoat was replaced by Ludox AM TM, a colloidal silica manufactured by the E. I. Du Pont De Nemours Company. The second coating application containing the overcoat of Example 1 of the invention was subjected to the same range of drying times and Wet Bulb temperatures as the application containing the control overcoat. The application containing the overcoat of Example 2 was subjected to a drying time of 1.20 minutes only, with the same range of Wet Bulb temperatures.

Reticulation ratings were obtained by applying to each coating a drop of distilled water with pH adjusted to values ranging from 7 to 12.2. The average degree of reticulation over the pH range was graded by visual examination and values assigned as listed below.

A=no reticulation
B=slight reticulation
C=moderate reticulation
D=objectionable reticulation
E=severe reticulation The reticulation ratings for the control and example coatings are shown in Table II. It is noted that as the drying time is decreased and the Wet Bulb temperature increased, the reticulation problem becomes more pronounced in the control coating. The coating of Example 1 of the invention containing Polymer 1 shows a marked improvement over the control under those drying conditions conducive to reticulation. Example 2, containing Polymer 1 and Ludox AM TM, also shows an improvement over the control at the 1.20 minute drying time under which it was coated.

EXAMPLE 3

Control 2 repeated the control coating of Example 1, except that 15 percent of the gelatin of the overcoat layer was replaced by polyacrylamide. In control 3, 15 percent of the overcoat gelatin was replaced by Polymer 2, a copolymer of acrylamide (95 weight percent) and (2-chloroethylsulfonylmethyl)styrene (5 weight percent). In Example 3, 15 percent of the overcoat gelatin was replaced by Polymer 1. The three coatings were compared after a Stage 2 drying time of the second coating application of 1.5 minutes and a Wet Bulb temperature of 20° C. (harsh temperature conditions) during drying. The controls showed a reticulation rating of E, while Example 3 showed an improvement to D. Polyacrylamide itself is thus not effective in carrying out the improvement of this invention: a copolymer containing a substantial molar proportion of a cross-linking monomer such as (2-chlorosulfonylmethyl)styrene is necessary in order to show a reticulation improvement.

TABLE I

| Layer | Wet Coverage cc/m² | Gelatin Coverage g/m² | Silver Halide Coverage g/m² | Coupler Coverage g/m² |
|---|---|---|---|---|
| | Coating Structure of the Control Coating | | | |
| | 2nd coating application: | | | |
| overcoat | 11 | 0.98 | — | — |
| 5 | 41 | 2.57 | 1.22 | 1.27 |
| | 1st coating application: | | | |
| 4 | 7 | 0.62 | — | — |
| 3 | 36 | 3.10 | 0.68 | 1.66 |
| 2 | 7 | 0.62 | — | — |
| 1 | 57 | 3.40 | 1.12 | 2.10 |

TABLE II

| Wet Bulb Temperature During Stage 2 of Drying of the Second Coating Application | Control Overcoat | Example 1 Polymer 1 | Example 2 Polymer 1 +Ludox AM |
|---|---|---|---|
| | Reticulation Ratings | | |
| | 1.20 minute Dry Time | | |
| 12° C. | D | — | B |
| 13° C. | C | C | — |
| 14° C. | E | C | C |
| 16° C. | E | D | — |
| 17° C. | D | — | C |
| | 1.33 minute Dry Time | | |
| 12° C. | B | B | |
| 13° C. | B | B | |

TABLE II-continued

| Wet Bulb Temperature During Stage 2 of Drying of the Second Coating Application | Control Overcoat | Example 1 Polymer 1 | Example 2 Polymer 1 +Ludox AM |
|---|---|---|---|
| | Reticulation Ratings | | |
| 14° C. | C | A | |
| 16° C. | C | B | |
| 17° C. | C | B | |
| | 1.60 minute Dry Time | | |
| 12° C. | A | A | |
| 13° C. | A | A | |
| 14° C. | B | A | |
| 16° C. | B | A | |
| 17° C. | B | A | |

EXAMPLES 4-5

The control coating of Example 1 was repeated and Example 4 comprises the same control with 14 percent gelatin replacement with the polymer of Example 3. Example 5 comprises the control with 14 percent gelatin replacement with an amine-containing polymer poly(acrylamide-co-N-(3-aminopropyl)methacrylamide) hydrochloride) (95:5) in the overcoat layer. The hardener, bis(vinylsulfonyl)methane is present in the layer in an amount of 1.75 weight percent of gelatin. Reticulation was examined under the conditions recited in Example 2 (spot reticulation) and also after processing in the Kodak ECP-2 process under harsher conditions (practical reticulation) and reported in terms of degrees. The reticulation figures were arrived at by visual examination of the samples after processing. A scale from zero (no reticulation) to 10 (severe reticulation) was used in rating the samples. For spot reticulation, values below 3 would be acceptable for reticulation and for the practical test a value of 7 would be acceptable.

The results are described in Table III.

TABLE II

| Average Coating Temperature During Drying | Control SR* | Control PR** | Example 4 SR* | Example 4 PR** | Example 5 SR* | Example 5 PR** |
|---|---|---|---|---|---|---|
| | 1.20 Dry Time (1.03 minutes in Zone B) | | | | | |
| 12° C. | 3.0 | 7 | 2.0 | 3 | 2.2 | 2 |
| 13° C. | 2.2 | 10 | 2.2 | 7 | 2.6 | 7 |
| 14° C. | 3.4 | 10 | 2.2 | 7 | 3.0 | 7 |
| 16° C. | 3.8 | 10 | 2.8 | 7 | 3.0 | 7 |
| 17° C. | 3.0 | 10 | — | — | — | — |

*SR = spot reticulation
**PR a= practical reticulation

The invention has been described in detail with particular reference to preferred embodiments thereof, but it will be understood that variations and modifications can be effected within the spirit and scope of the invention.

What is claimed is:

1. An element comprising a support having thereon at least two contiguous gelatin-containing layers, the first uppermost layer containing an essentially water-soluble, non-diffusible vinyl polymer having one or more groups selected from the group consisting of 1) groups which react with gelatin to crosslink the polymer and gelatin and 2) amine groups, said uppermost layer containing from about 1 to about 90% by weight of said polymer and having a lateral swell coefficient in the absence of said polymer at least 10% greater than the second lower gelatin-containing layer, said first uppermost layer containing the polymer having amine groups also containing a hardener for gelatin, wherein said polymer reduces reticulation in said element.

2. The element of claim 1 wherein the polymer has repeating units having the formula:

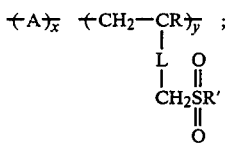

where

A is a polymerized $\alpha,\beta$-ethylenically unsaturated addition polymerizable monomer or a mixture of such polymerized monomers;

x is a positive number such that (A) comprises 10 to 99% by weight of said polymer;

y is a positive number such that

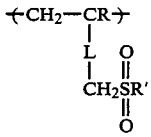

comprises 1 to 90% by weight of said polymer;

L is a linking group selected from the group consisting of alkylene, arylene, COZ and $COZR^3$;

$R^3$ is selected from the group consisting of alkylene and arylene;

Z is O or NH;

R is hydrogen or alkyl having 1 to 6 carbon atoms;

R' is $—CH{=}CHR^2$ or $—CH_2CH_2X$ where X is a leaving group which can be displaced by a nucleophile or can be eliminated in the form of HX upon treatment with base; and $R^2$ is hydrogen, alkyl or aryl.

3. The element of claim 2 wherein X is selected from the group consisting of chloro, bromo, iodo, acetoxy, methylsulfonyloxy, trimethylammonio salt and pyridinio salt.

4. The element of claim 2 wherein A is derived from 2-acrylamido-2-methylpropanesulfonic acid and salts thereof, acrylamide, vinylbenzyl chloride, styrene or maleic anhydride.

5. The element of claim 2 wherein L is phenylene.

6. The element of claim 2 wherein said polymer has repeating units having the formula:

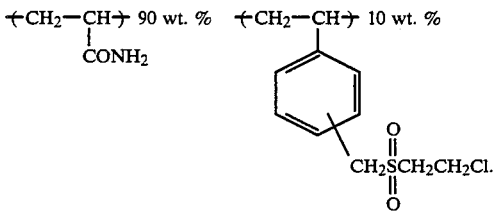

7. The element of claim 1 wherein said vinyl polymer containing amine groups has repeating units having the formula:

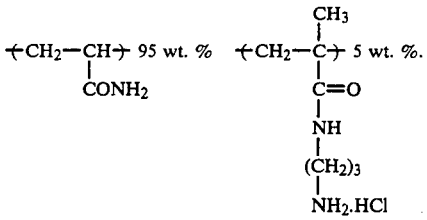

8. The element of claim 3 wherein said polymer comprises from about 10 to about 20% by weight gelatin in the first uppermost layer.

9. The element of claim 8 wherein the first uppermost layer comprises a hardener for gelatin.

10. The element of claim 2 wherein the uppermost layer comprises colloidal silica.

11. The element of claim 1 wherein the hardener is bis(vinylsulfonyl)methane.

12. A photographic element comprising a support having thereon a gelatin-containing radiation-sensitive layer and an overcoat layer comprising gelatin and an essentially water-soluble, non-diffusible vinyl polymer having one or more groups selected from the group consisting of 1) groups which react with gelatin to crosslink the polymer and gelatin and 2) amine groups, said overcoat layer comprising from about 1 to about 90% by weight of said polymer, said overcoat layer containing the polymer having amine groups also containing a hardener for gelatin, wherein said polymer reduces reticulation in said element.

13. The photographic element of claim 12 wherein the radiation-sensitive layer contains silver halide.

14. The photographic element of claim 12 wherein the polymer has repeating units having the formula:

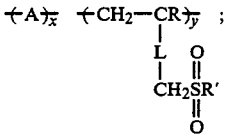

where

A is a polymerized $\alpha,\beta$-ethylenically unsaturated addition polymerizable monomer or a mixture of such polymerized monomers;

x is a positive number such that (A) comprises 10 to 99% by weight of said polymer;

y is a positive number such that

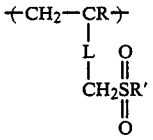

comprises 1 to 90% by weight of said polymer;

L is a linking group selected from the group consisting of alkylene, arylene, COZ and $COZR^3$;

$R^3$ is selected from the group consisting of alkylene and arylene;

Z is O or NH;

R is hydrogen or alkyl having 1 to 6 carbon atoms;

R' is $—CH{=}CHR^2$ or $—CH_2CH_2X$ where X is a leaving group which can be displaced by a nucleophile or can be eliminated in the form of HX upon treatment with base; and $R^2$ is hydrogen, alkyl or aryl.

15. The photographic element of claim 14 wherein the overcoat layer comprises a hardener for gelatin.

16. The photographic element of claim 15 wherein the hardener for gelatin is bis(vinylsulfonyl)methane or bis(vinylsulfonylmethyl) ether.

17. The photographic element of claim 14 wherein X is selected from the group consisting of chloro, bromo, iodo, acetoxy, methylsulfonyloxy, trimethylammonio salt and pyridinio salt.

18. The photographic element of claim 14 wherein A is derived from 2-acrylamido-2-methylpropanesulfonic acid and salts thereof, acrylamide, vinylbenzyl chloride, styrene or maleic anhydride.

19. The photographic element of claim 14 wherein L is phenylene.

20. The photographic element of claim 14 wherein the polymer has repeating units having the formula:

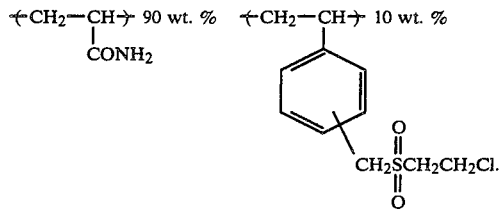

21. The photographic element of claim 12 wherein the polymer has repeating units having the formula:

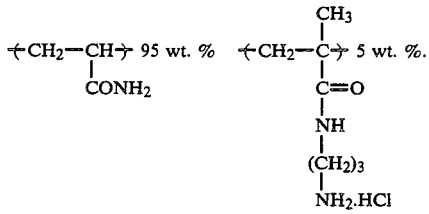

22. The element of claim 14 comprising from about 10 to about 20% by weight of the polymer in the overcoat layer.

* * * * *